US008262547B2

(12) United States Patent
Lin

(10) Patent No.: US 8,262,547 B2
(45) Date of Patent: Sep. 11, 2012

(54) PNEUMATIC EXERCISE FOOT PAD DEVICE

(75) Inventor: William Lin, Taichung (TW)

(73) Assignee: Asia Regent Limited, Taichung (TW)

( * ) Notice: Subject to any disclaimer, the term of this patent is extended or adjusted under 35 U.S.C. 154(b) by 137 days.

(21) Appl. No.: 12/857,712

(22) Filed: Aug. 17, 2010

(65) Prior Publication Data

US 2011/0269603 A1 Nov. 3, 2011

(51) Int. Cl.
*A63B 21/008* (2006.01)

(52) U.S. Cl. ..... 482/111; 482/53

(58) Field of Classification Search ..... 482/44, 482/49, 51, 52, 53, 79, 111, 112, 113, 121, 482/122, 126, 148, 908; 446/220, 222; 5/630, 5/633, 637; D21/662, 666, 671, 684, 686
See application file for complete search history.

(56) References Cited

U.S. PATENT DOCUMENTS 4,405,129 A * 9/1983 Stuckey ..... 482/112
5,186,700 A * 2/1993 Wang ..... 482/111
5,236,407 A * 8/1993 Wang ..... 482/113
5,256,118 A * 10/1993 Chen ..... 482/53
5,267,923 A * 12/1993 Piaget et al. ..... 482/53
5,346,444 A * 9/1994 Hsieh ..... 482/53
6,045,489 A * 4/2000 Levine et al. ..... 482/53
6,419,611 B1 * 7/2002 Levine et al. ..... 482/53
6,918,862 B1 * 7/2005 Comeau ..... 482/111
7,207,930 B2 * 4/2007 Bonutti ..... 482/111
7,614,978 B2 * 11/2009 Piaget et al. ..... 482/53
D630,274 S * 1/2011 Babiarz ..... D21/686

FOREIGN PATENT DOCUMENTS

GB 2031742 A * 10/1979

* cited by examiner

*Primary Examiner* — Stephen Crow
*Assistant Examiner* — Tam Nguyen
(74) *Attorney, Agent, or Firm* — Whyte Hirschboeck Dudek SC

(57) ABSTRACT

A pneumatic exercise foot pad device includes two primary tubes and a secondary tube disposed between left and right foot pads having air chambers. The primary tubes intercommunicate fluidly the foot pads in proximity to front and rear ends of the foot pads. The secondary tube intercommunicates fluidly central portions of the foot pads. A shell is disposed between the left and right foot pads to cover the primary and secondary tubes. Two adjustment screw rods extend respectively through screw holes formed in the shell to press or unpress the primary tubes so that the primary tubes block or unblock an air flow between the foot pads.

5 Claims, 19 Drawing Sheets

PNEUMATIC EXERCISE FOOT PAD DEVICE

BACKGROUND OF THE INVENTION

1. Field of the Invention

The invention relates to a pneumatic exercise foot pad device, and more particularly to a pneumatic exercise foot pad device with operational adjustability.

2. Description of the Related Art

FIG. 1 shows a conventional pneumatic exercise foot pad device 100 that includes a pair of pads 11 and a pair of tubes 12 that are formed integrally with the pads 11. When a user treads on the pads 11 by alternately treading one pad 11 up and the other pad 11 down using his two feet, air in the pads 11 flows through the tubes 12 to drive deformation of the pads 11. In this manner, the muscular strength of the feet or legs can be enhanced.

However, since the resistance blocking air flow through the tubes 12 cannot be adjusted, the resistance against the two feet also cannot be adjusted. Hence, the pneumatic exercise foot pad device 100 has the disadvantages of a monotonic process and poor operational variation. Moreover, because the tubes 12 are disposed only in the front and rear positions of the pads 11, when one foot presses downward, the central portion of the foot pad 11 on which this foot treads protrudes rather than keeping an even overall upper surface. If the user cannot adjust his body balance or center of gravity to accommodate the protruding center portion of the pad 11, he may become unbalanced and may fall. Hence, it is not safe to use the pneumatic exercise foot pad device 100.

FIG. 2 shows another conventional pneumatic exercise foot pad device 120 that includes a pair of pads 13, a tube 14 connecting the pads 13, and a valve 15 attached to the pads 13. The pads 13 and the tube 14 are integrally formed, whereas the valve 15 is attached thereto thereafter. When a user steps on the pads 13, by operating the valve 15, the resistance blocking air flow through the valve 15 can be adjusted to change the treading force on the corresponding treading area.

However, because the valve 15 is not integrally formed with the pads 13, after a period of use, the seal between the pads 13 and the valve 15 may allow air to escape. Furthermore, because only a partial area is used for air flow adjustment, it is difficult to control the resistance forces at the front and rear portions of the pads 13. Moreover, the pneumatic exercise foot pad device 120 still has the disadvantage of not evenly raising the upper surface of the pads 13.

FIG. 3 shows a stepper to exercise the muscular strength of the feet. The stepper has multiple disadvantages. For example, the tread pad is too rigid making the stepper uncomfortable to use. In addition, the stepper has monotonic process and poor operational variation, and is unable to train a user's balance sense.

SUMMARY OF THE INVENTION

Therefore, the main object of the present invention is to provide a pneumatic exercise footpad device that has adjustable resistance.

Accordingly, a pneumatic exercise foot pad device of the present invention comprises left and right foot pads, two primary tubes, a secondary tube and a flow regulator.

Each of the pads has an air chamber. The primary tubes and the secondary tube are disposed between the left and right foot pads. One of the primary tubes intercommunicates fluidly front ends of the left and right foot pads. The other one of the primary tubes intercommunicates fluidly rear ends of the left and right footpads. The secondary tube intercommunicates fluidly central portions of the left and right foot pads. The secondary tube is disposed between the primary tubes. The left and right foot pads and the primary and secondary tubes are made of a flexible plastic material.

a shell is disposed between the left and right foot pads to cover the primary tubes and is made of a material stiffer than the flexible plastic material. The flow regulator includes two screw holes formed in the shell in proximity to the primary tubes, respectively, and two adjustment screw rods that are inserted into the shell respectively through the screw holes and that are operable to move inwardly of the shell to press the primary tubes, or outwardly of the shell to unpress the primary tubes. The primary tubes are compressible to reduce or block a fluid flow between the left and right foot pads when being pressed by the adjustment screw rods, respectively.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
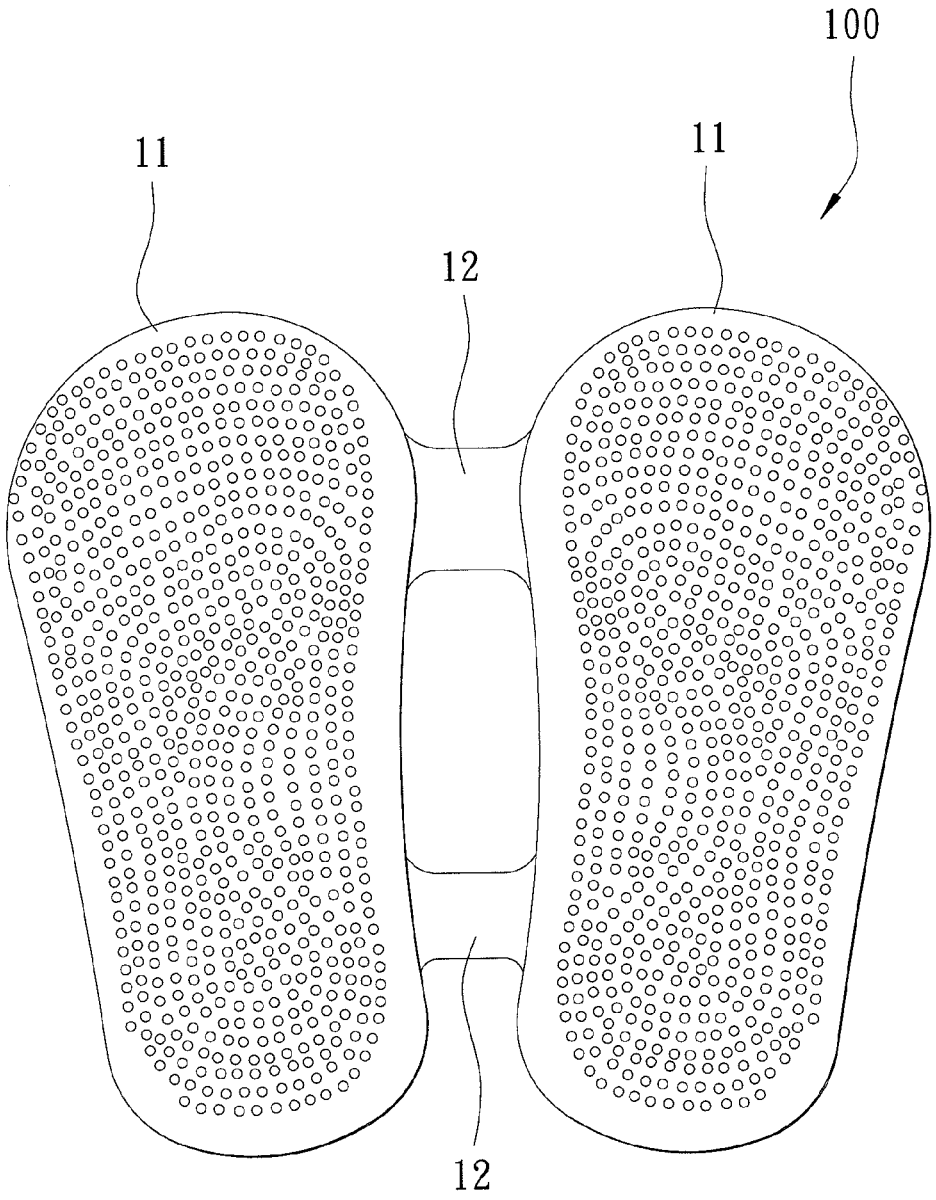
FIG. 1 PRIOR ART
FIG. 1 is a top view of a conventional pneumatic exercise foot pad device.
Figure 2:
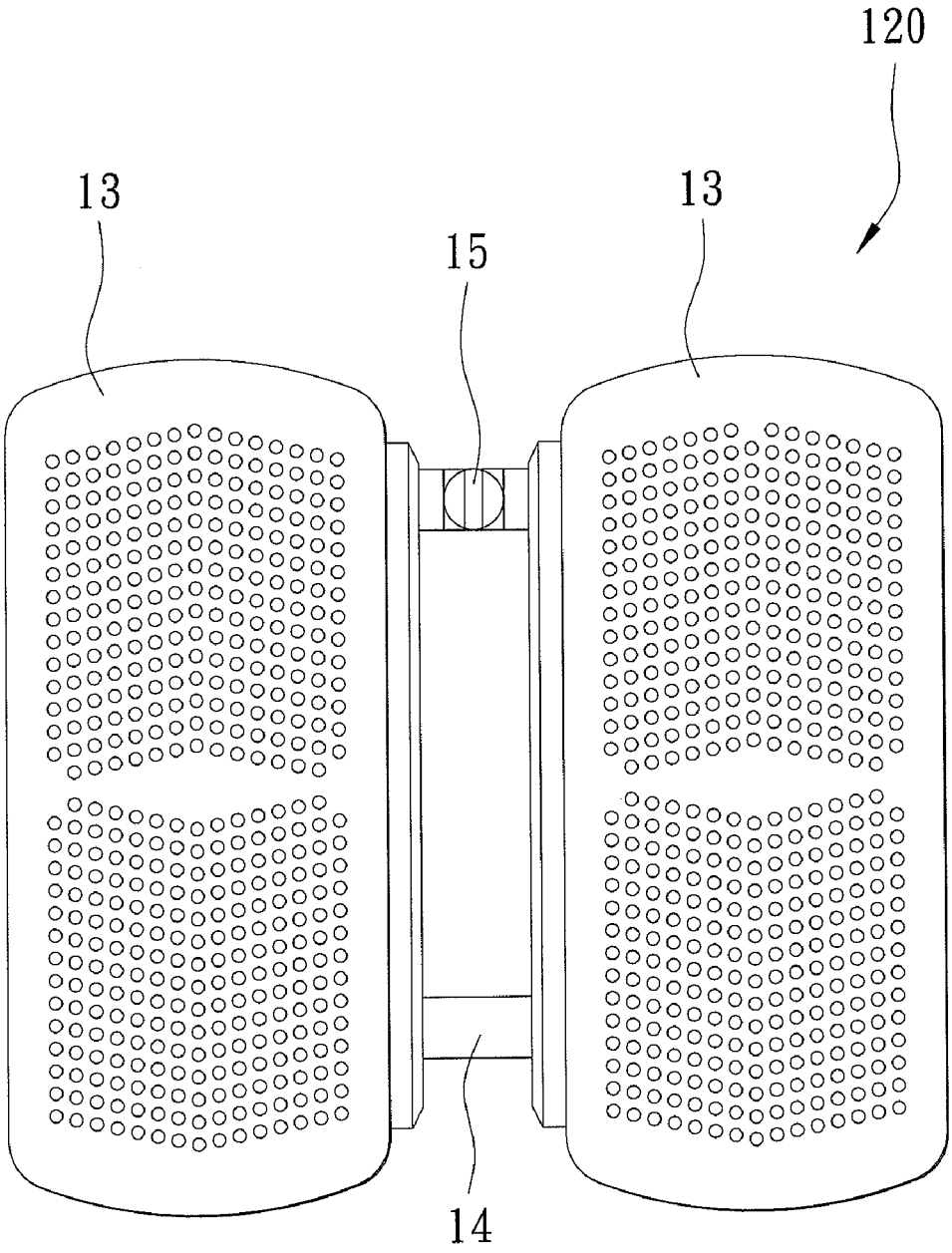
FIG. 2 PRIOR ART
FIG. 2 is a top view of another conventional pneumatic exercise foot pad device.
Figure 3:
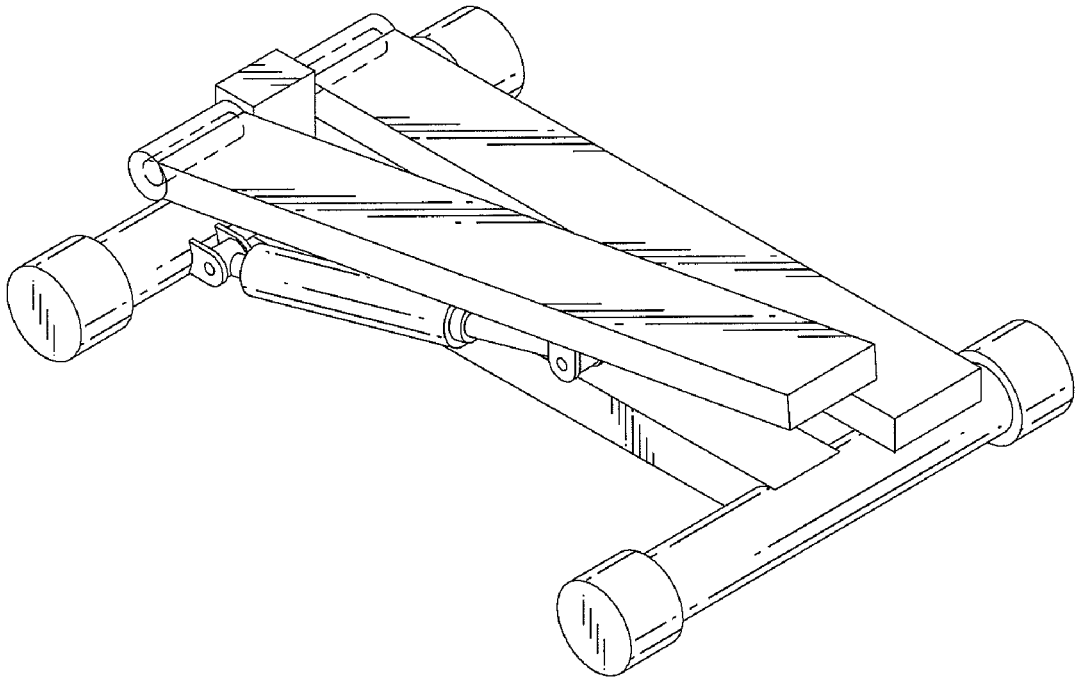
FIG. 3 is a perspective view of a stepper.
Figure 4:
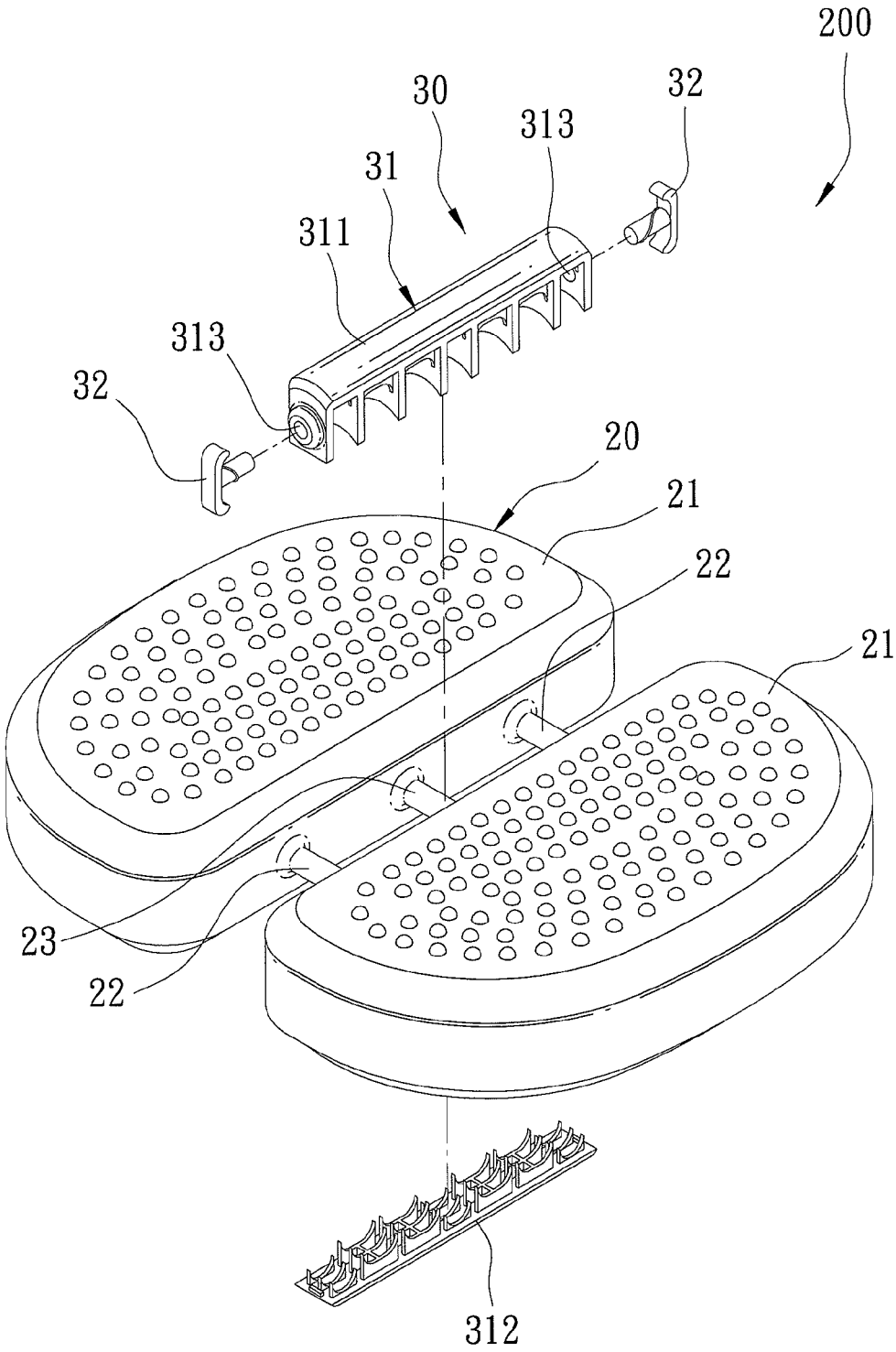
FIG. 4 is an exploded view of the preferred embodiment of a pneumatic exercise foot pad device according to the present invention.
Figure 5:
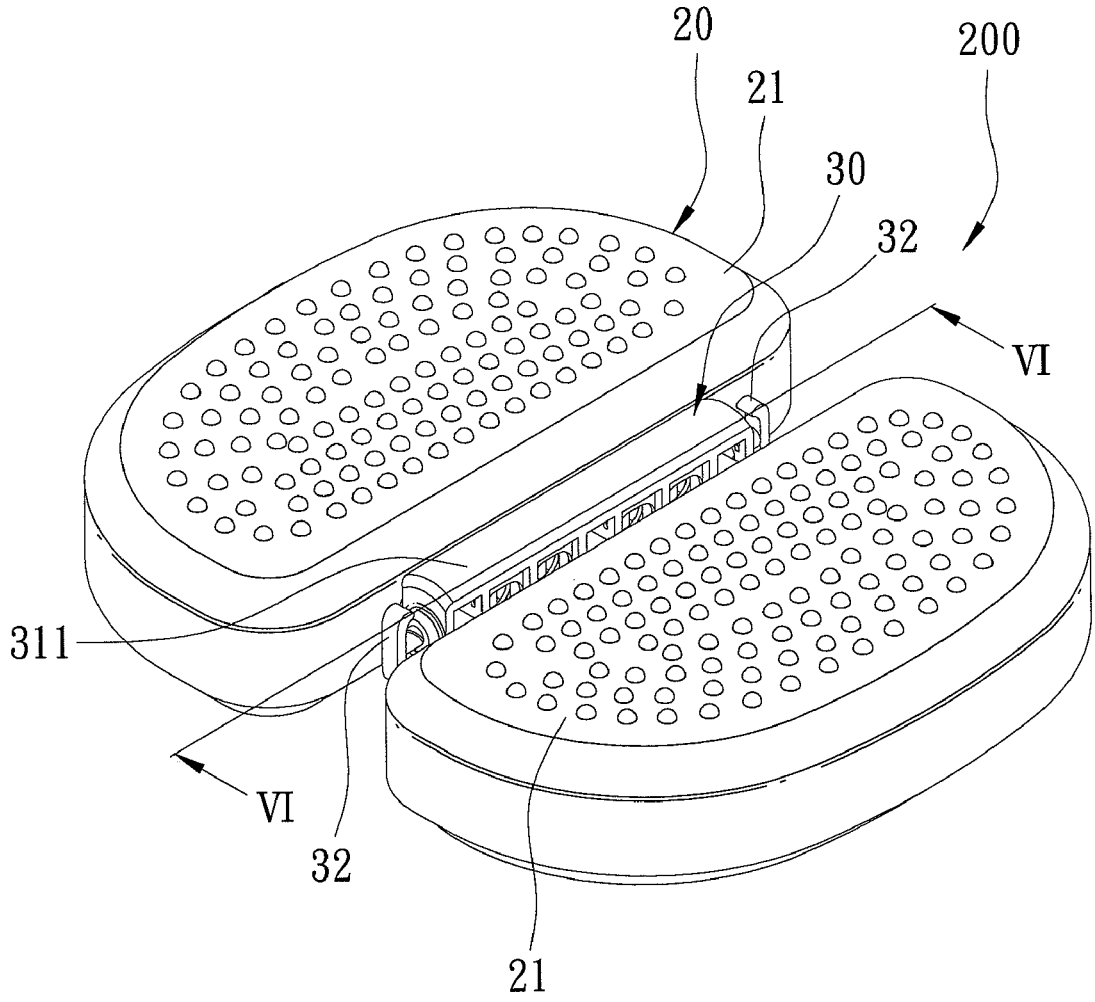
FIG. 5 is a perspective view of the preferred embodiment in an assembled state.

Before the present invention is described in greater detail with reference to the accompanying preferred embodiments, it should be noted herein that like elements are denoted by the same reference numerals throughout the disclosure.

Referring to FIGS. 4, 5, 6 and 18, a pneumatic exercise foot pad device 200 according to a preferred embodiment of the present invention is shown to include left and right foot pads 21, two primary tubes 22, a secondary tube 23, a flow regulator 30 and a handle unit 40.

Referring to FIGS. 4, 5, 6 and 10, each of the left and right foot pads 21 has an air chamber 211. The primary tubes 22 are disposed between the left and right foot pads 21 and are integrally formed with the foot pads 21 in proximity to front and rear ends of the left and right foot pads 21, respectively. One of the primary tubes 22 intercommunicates fluidly front ends of the left and right foot pads 21. The other one of the primary tubes 22 intercommunicates fluidly rear ends of the left and right foot pads 21.

The secondary tube 23 is disposed between the primary tubes 22 and is integrally formed with the foot pads 21. The secondary tube 23 intercommunicates fluidly central portions of the foot pads 21.

Figure 18:
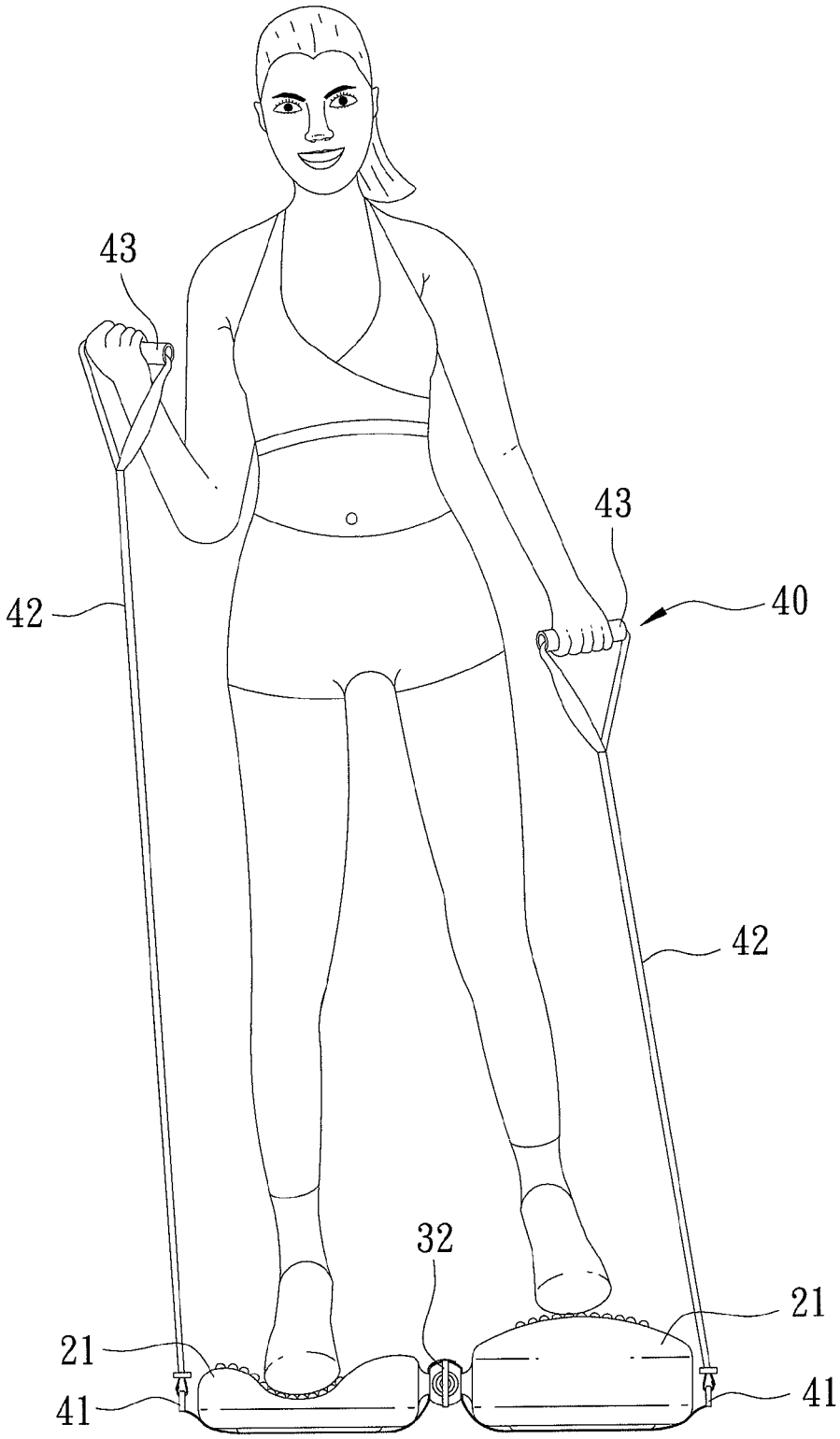
FIG. 18 illustrates an eighth exercise using the preferred embodiment.

In this embodiment, the left and right foot pads 21 and the primary tubes 22 and the secondary tube 23 are made of a flexible plastic material. The secondary tube 23 permits an air flow between the central portions of the air chambers 211. As shown in FIG. 18, when one of the foot pads 21 is pressed by the user's foot, the air therein can flow to the other foot pad 21 through the secondary tube 23 in addition to the primary tubes 22 so that the central portion of the foot pad 21 can be depressed simultaneously with the front and rear portions thereof. With the provision of the secondary tube 23, the present invention can alleviate the problem of body imbalance caused by the conventional foot pad, in which the central portion is protruded relative to the front and rear portions, rather than being indented when pressed by the user's foot. As the central portion of the foot pad 21 in the present invention can be indented together with the front and rear portions thereof, the user is not likely to lose his balance when exercising with the foot pads 21.

A shell 31 is disposed between the left and right foot pads 21 to cover the primary tubes 22 and the secondary tube 23 and is made of a material stiffer than the flexible plastic material of the foot pads 21 and the primary and secondary tubes 22, 23.

The flow regulator 30 includes two screw holes 313 formed in the shell 31 in proximity to the primary tubes 22, respectively, and two adjustment screw rods 32 that are inserted into the shell 31 respectively through the screw holes 313 and that are operable to move inwardly of the shell 31 to press the primary tubes 22 against the shell 31, or outwardly of the shell 31 to unpress the primary tubes 22.

The shell 31 includes upper and lower shell members 311, 312 that are mated with each other. The upper and lower shell members 311, 312 respectively cover the upper and lower sides of the primary tubes 22 and the secondary tube 23. The primary tubes 22 are proximate to front and rear ends of the shell 31, respectively. In this embodiment, the screw holes 313 are formed respectively in the front and rear ends of the upper shell member 311. The screw holes 313 may also be formed in the lower shell member 312 as an alternative.

Figure 6:
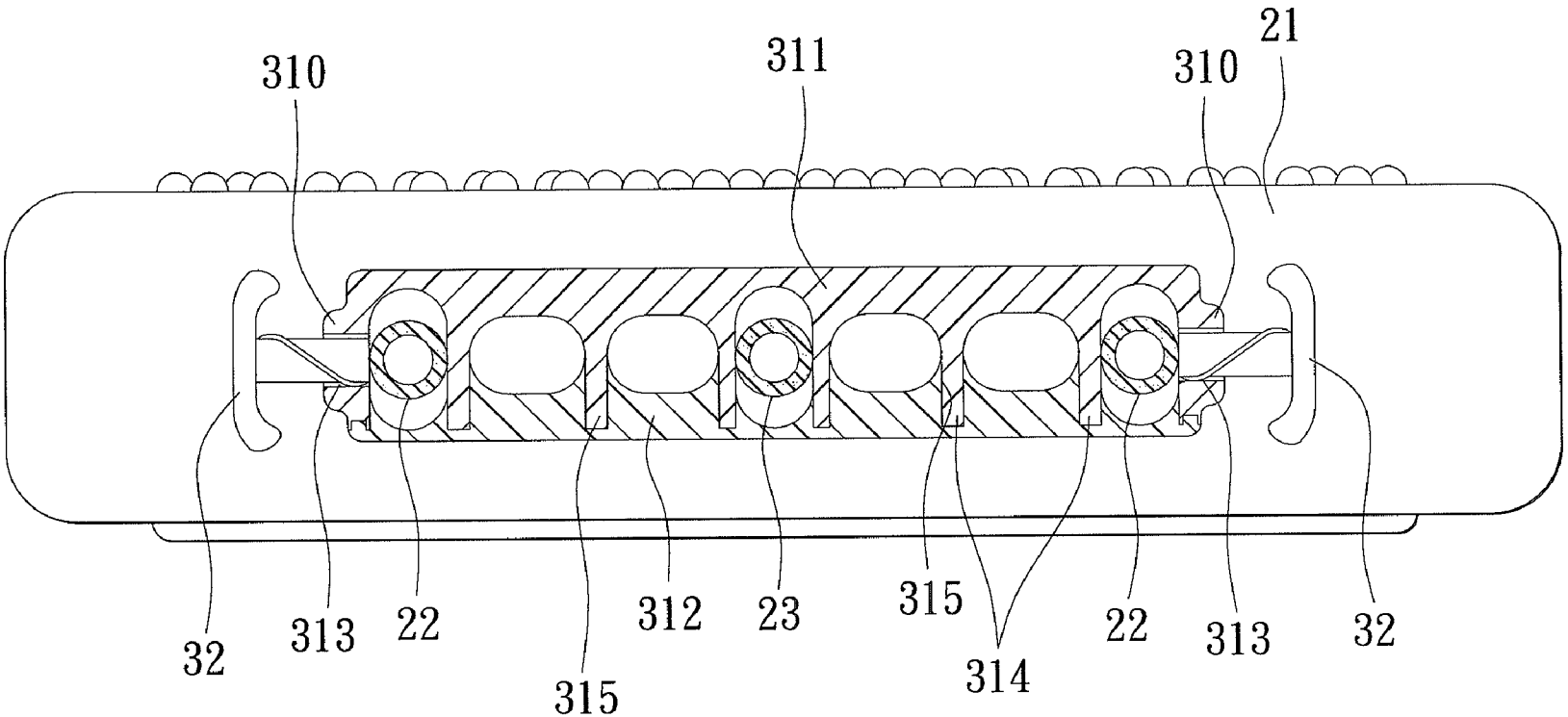
FIG. 6 is a sectional view taken along line 5-5 of FIG. 5.

Particularly, as shown in FIG. 6, the upper shell member 311 includes front and rear end walls 310 that are respectively provided with the screw holes 313, and a plurality of spaced apart ribs 314 between the front and rear end walls 310. The lower shell member 312 includes a plurality of spaced apart grooves 315, and the ribs 314 are fitted respectively into the grooves 315. The front one of the primary tubes 22 is disposed in a space between the front end wall 310 and one of the ribs 314, and the rear one of the primary tubes 22 is disposed in a space between the rear end wall 310 and another one of the ribs 314. The secondary tube 23 is disposed between two ribs 314.

Figure 7:
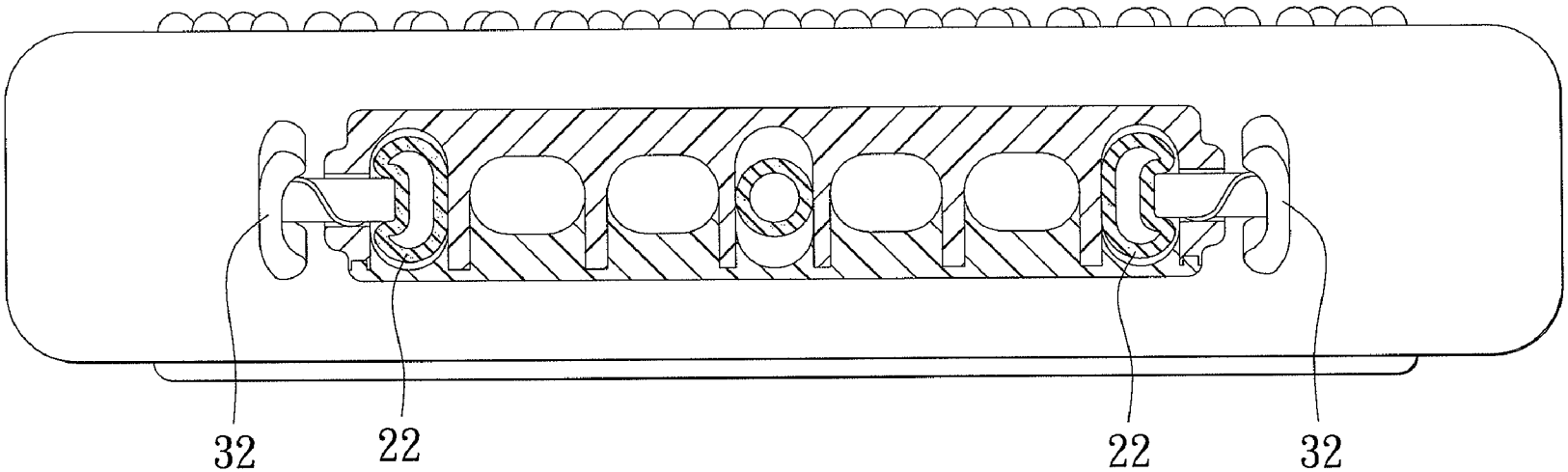
FIG. 7 is the same view as FIG. 6 but with two primary tubes being pressed.
Figure 8:
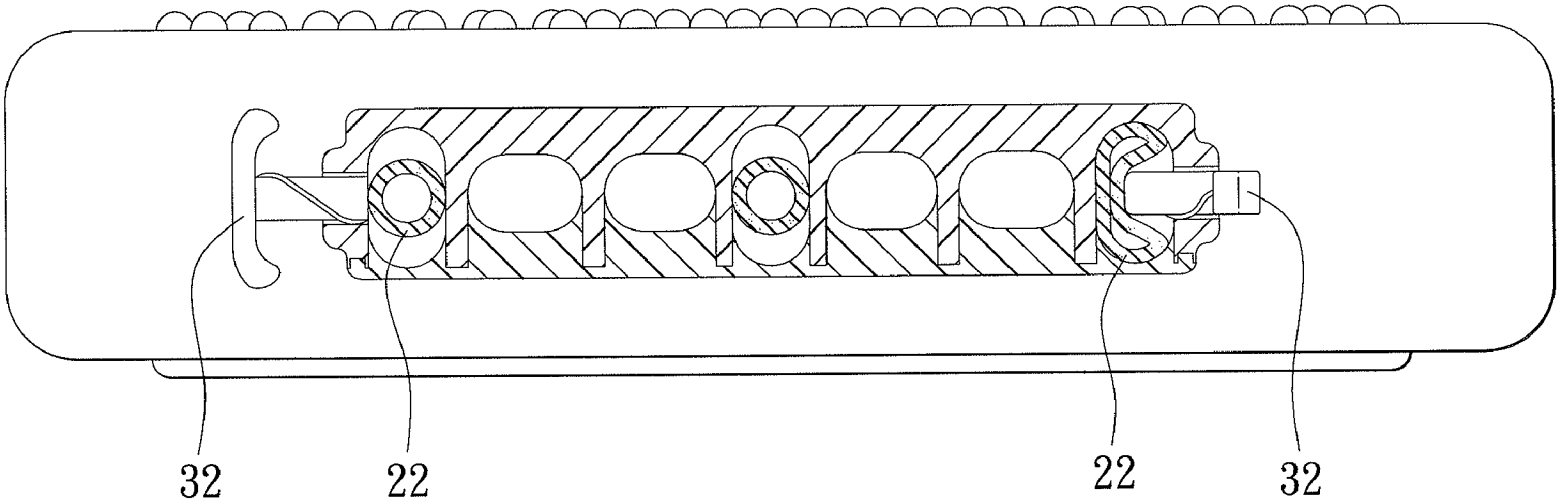
FIG. 8 is the same view as FIG. 6 but with the rear one of the primary tubes being pressed.
Figure 9:
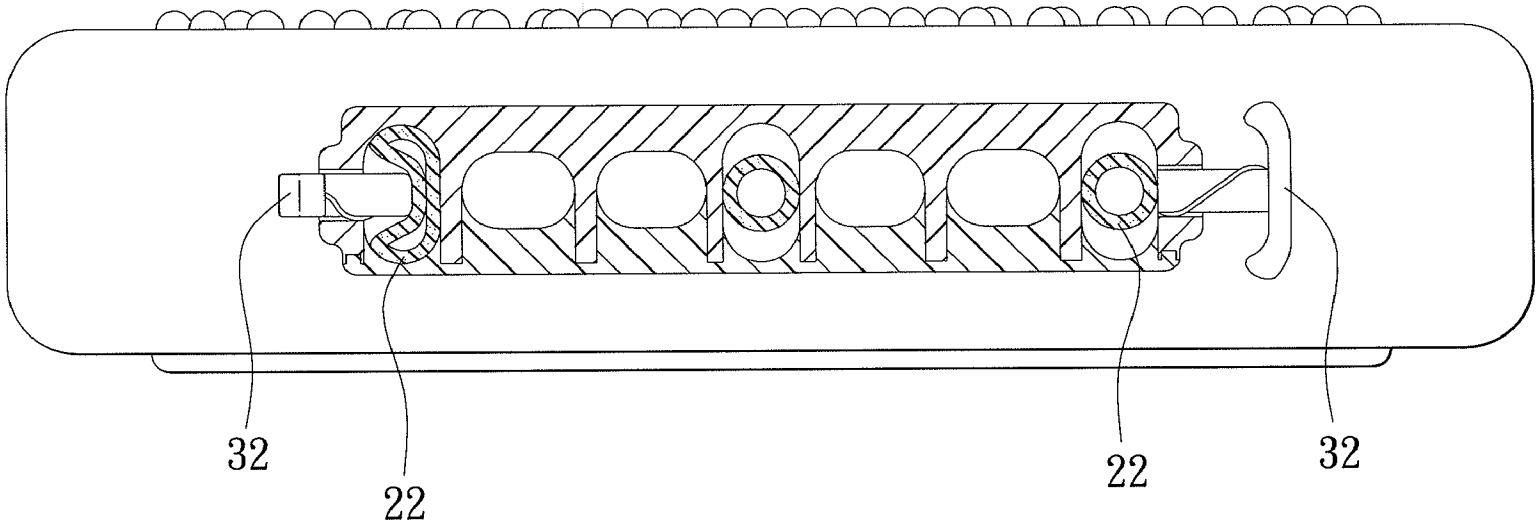
FIG. 9 is the same view as FIG. 6 but with the front one of the primary tubes being pressed.
Figure 10:
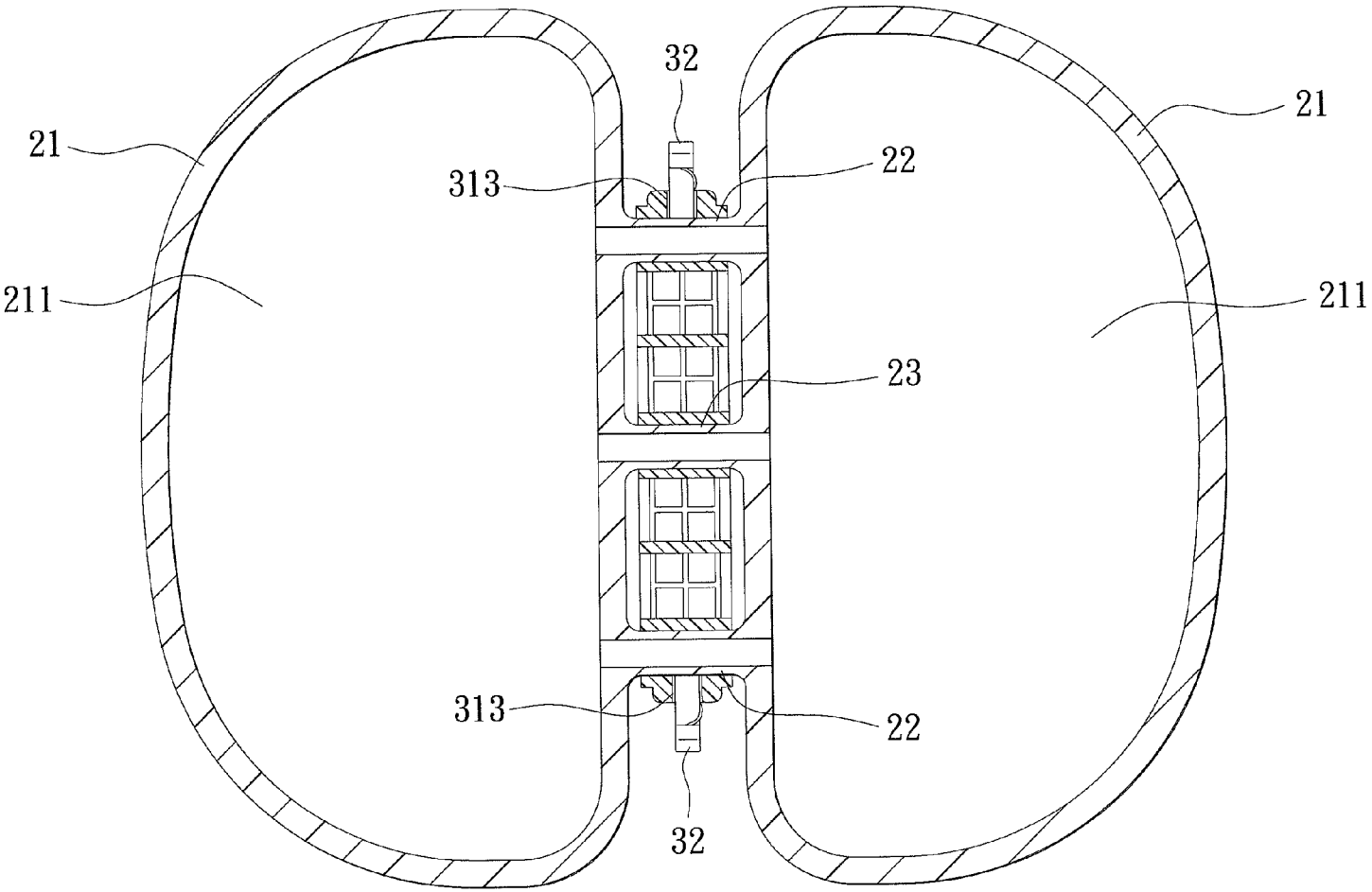
FIG. 10 is a sectional top view of the preferred embodiment.

The primary tubes 22 are compressible to reduce or block a fluid flow between the air chambers 211 of the left and right foot pads 21 when being pressed by the adjustment screw rods 32. Referring to FIG. 7, both of the adjustment screw rods 32 are rotated to move inward and press partially and respectively the primary tubes 22 such that the flow rate in each primary tube is reduced to half of its original flow rate. Referring to FIG. 8, the adjustment screw rod 32 at the rear end wall 310 is moved inward to press the rear primary tube 22 to a relatively large extent such that the fluid flow in the rear primary tube 22 is reduced considerably. Referring to FIG. 9, the adjustment screw rod 32 at the front end wall 310 is moved inward to press the front primary tube 22 to a relatively large extent such that the fluid flow in the front primary tube 22 is reduced considerably.

Figure 11:
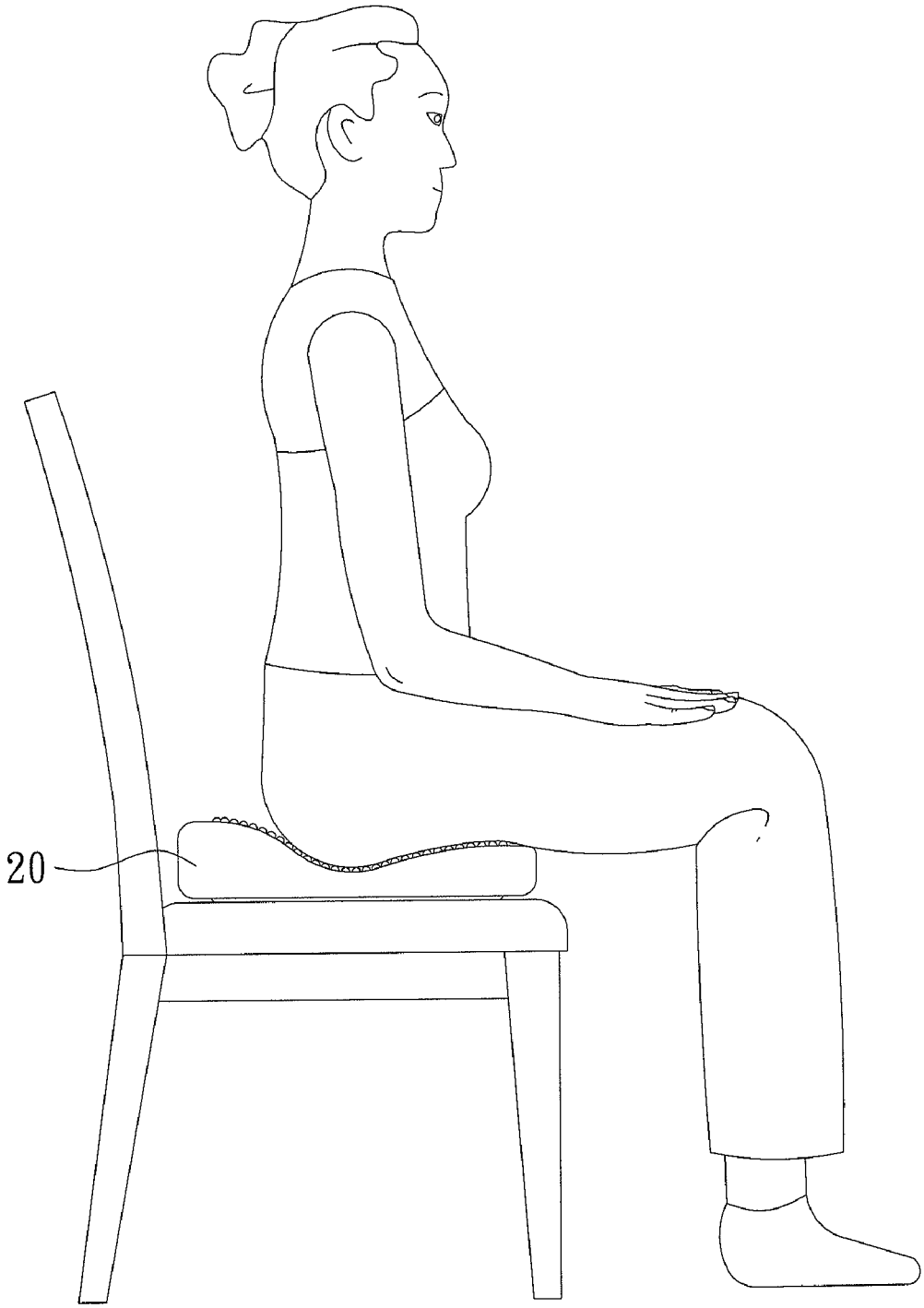
FIG. 11 illustrates a first exercise using the preferred embodiment.
Figure 12:
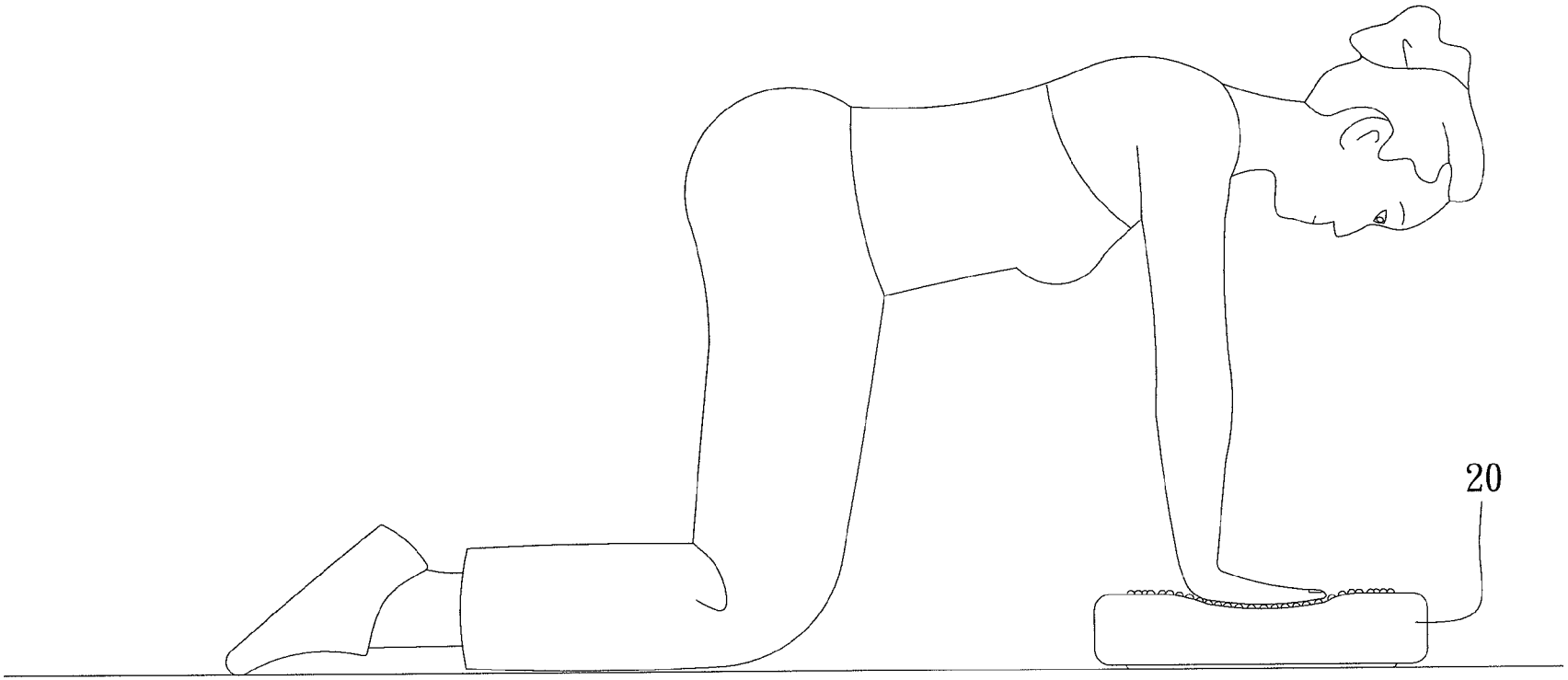
FIG. 12 illustrates a second exercise using the preferred embodiment.
Figure 13:
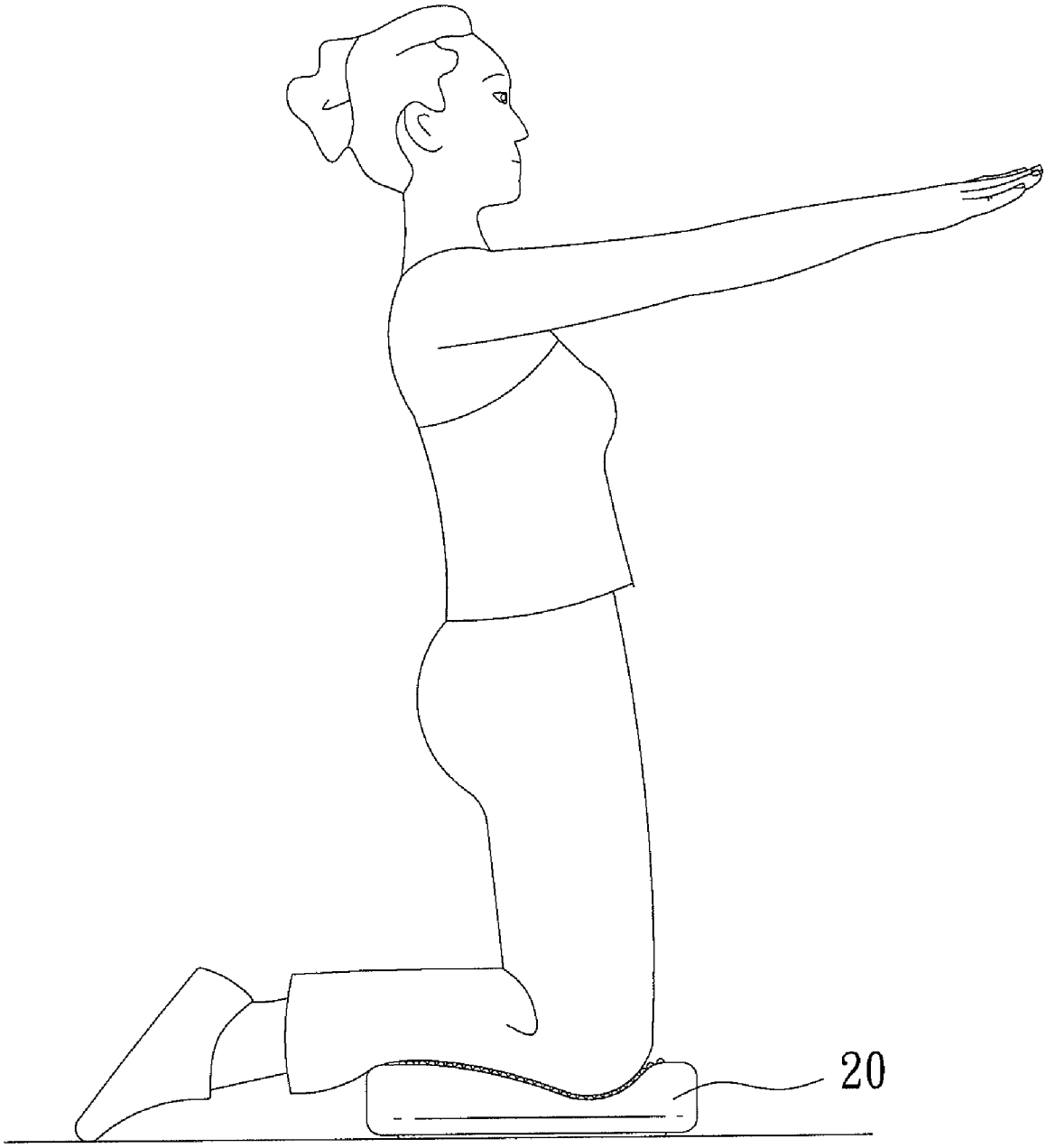
FIG. 13 illustrates a third exercise using the preferred embodiment.

Referring to FIGS. 11 to 13, the foot pads 21 may be used in multiple ways. For example, the user can adopt a sitting pose and train the muscular strength of her lower body by shifting her body left and right (as shown in FIG. 11). The user may also press alternately the foot pads 21 using her hands to train the muscular strength of her arms (as shown in FIG. 12). The user may also adopt a kneeling pose to train the muscular strength of her legs by shifting her body left and right (as shown in FIG. 13).

Figure 14:
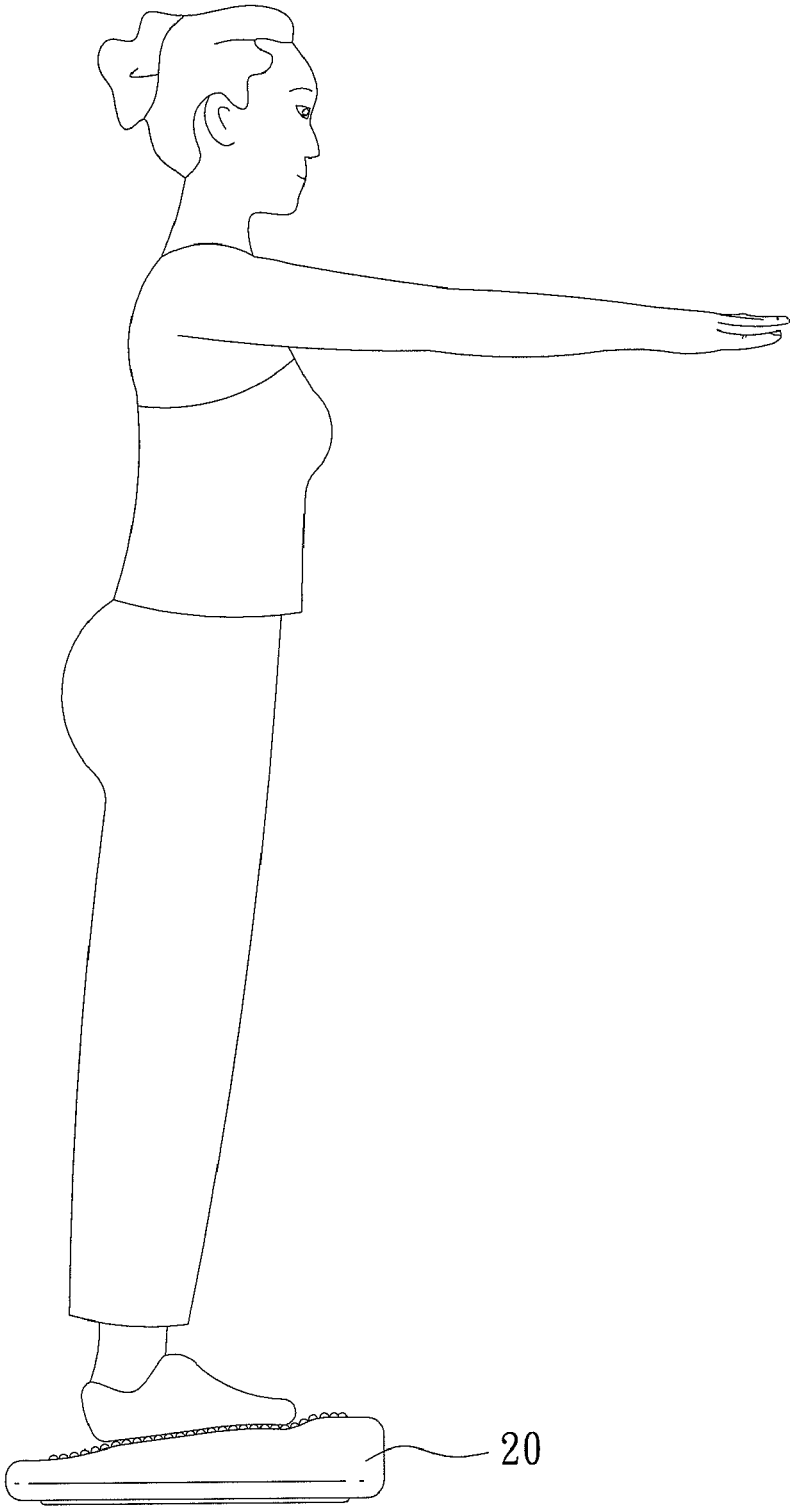
FIG. 14 illustrates a fourth exercise using the preferred embodiment.
Figure 15:
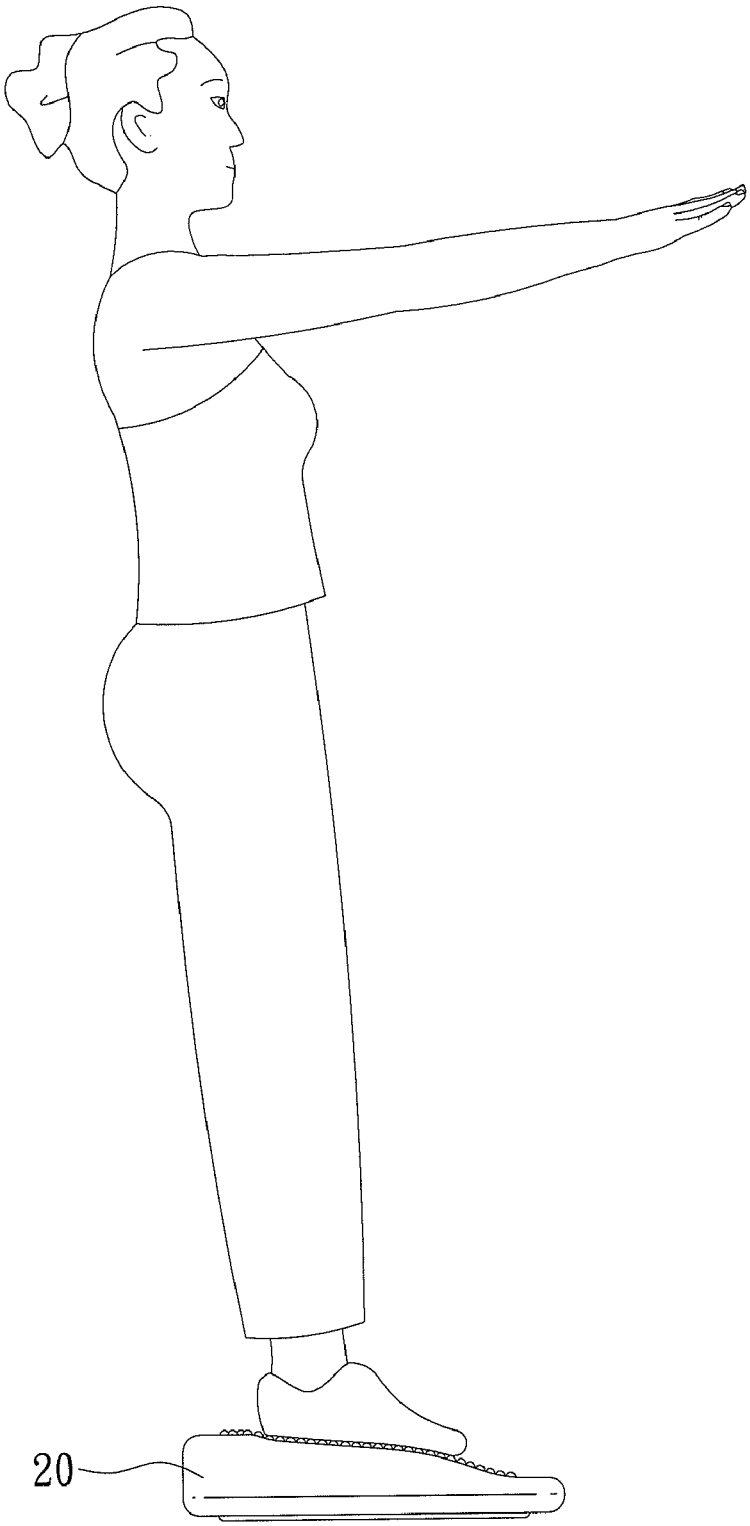
FIG. 15 illustrates a fifth exercise using the preferred embodiment.

As shown in FIGS. 8, 9, 14 and 15, the user adopts a standing pose for exercise. When the rear one of the primary tubes 22 is pressed and blocked, the front sides of the foot pads 21 may be raised by air flow, and the center of gravity of the user may be shifted rearwardly (as shown in FIG. 14). When the front one of the primary tubes 22 is pressed and blocked, the rear sides of the foot pads 21 may be raised by air flow, and the gravity center of the user may be shifted frontwardly (as shown in FIG. 15). Therefore, through adjustment of the adjustment screw rods 32, the user may adjust his standing position and inclining angle to accommodate configuration changes of the foot pads 21 to perform balancing exercises.

Figure 16:
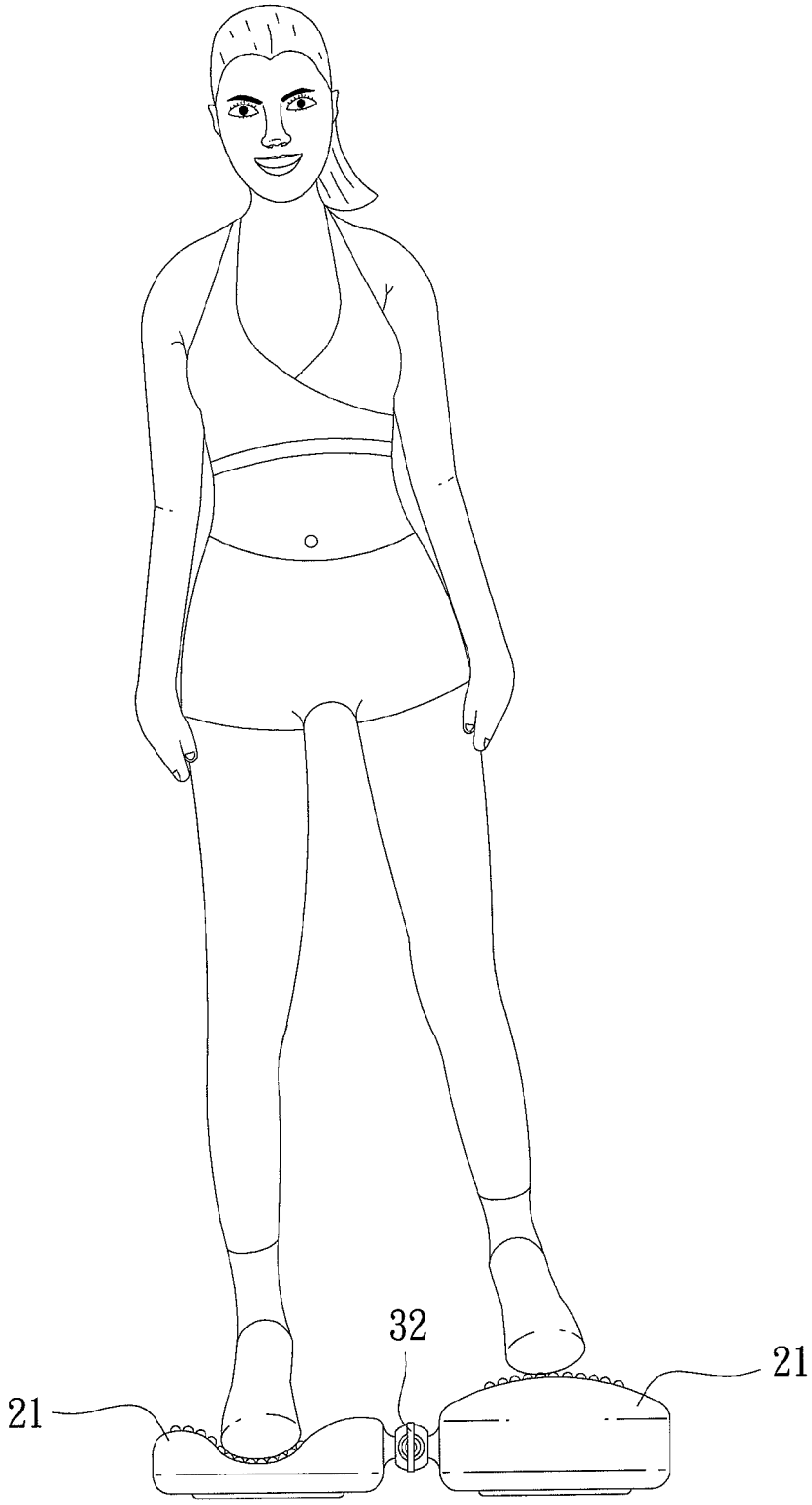
FIG. 16 illustrates a sixth exercise using the preferred embodiment.
Figure 17:
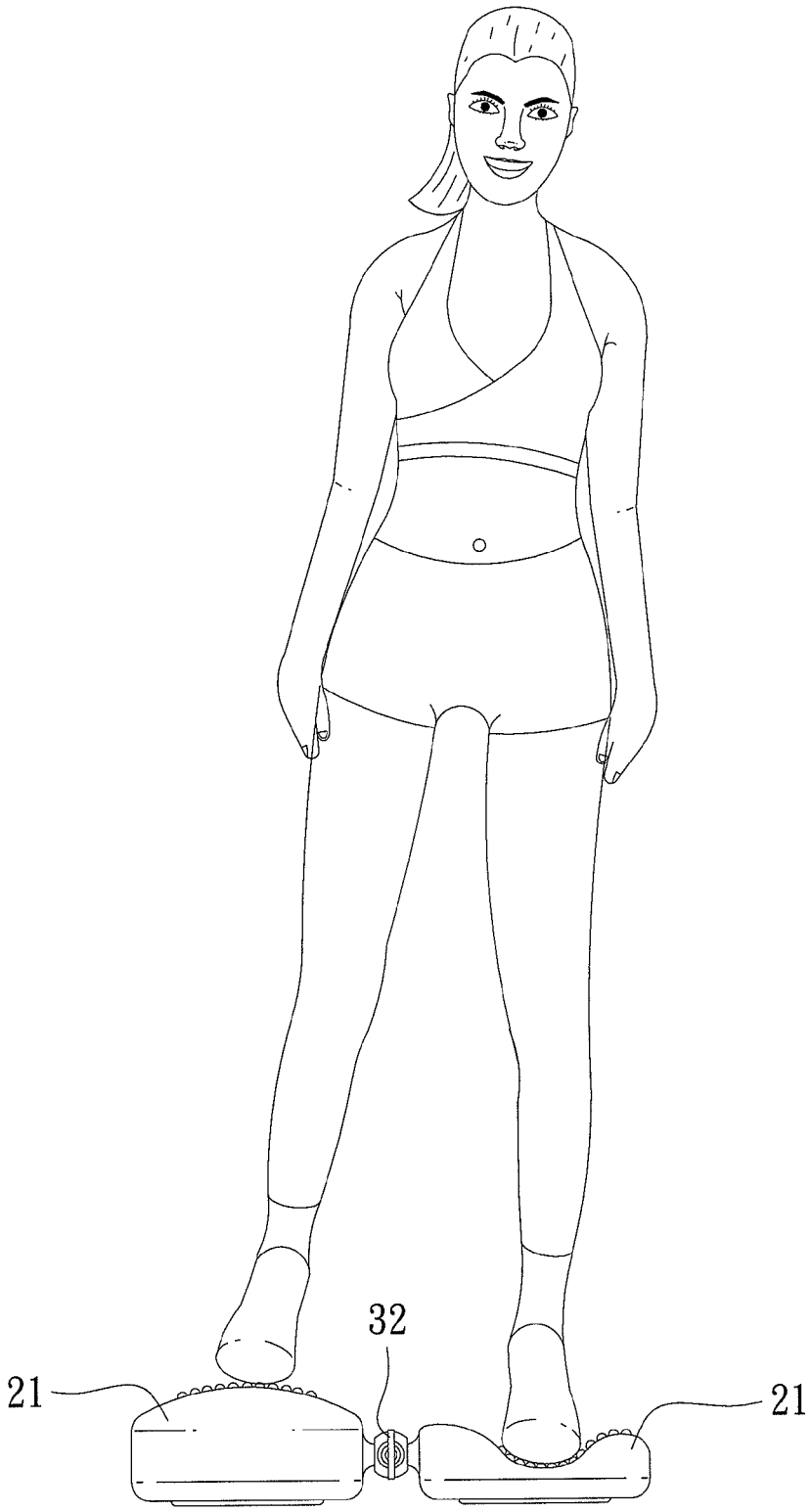
FIG. 17 illustrates a seventh exercise using the preferred embodiment.

As shown in FIGS. 16 and 17, stepping exercises may be conducted, during which the adjustment screw rods 32 may be adjusted to alter the resistance and flow speed of air through the primary tubes 22 and to further change the rate of deforming the foot pads 21. The stepping speed and resistance can also be tuned for stepping exercises.

Figure 19:
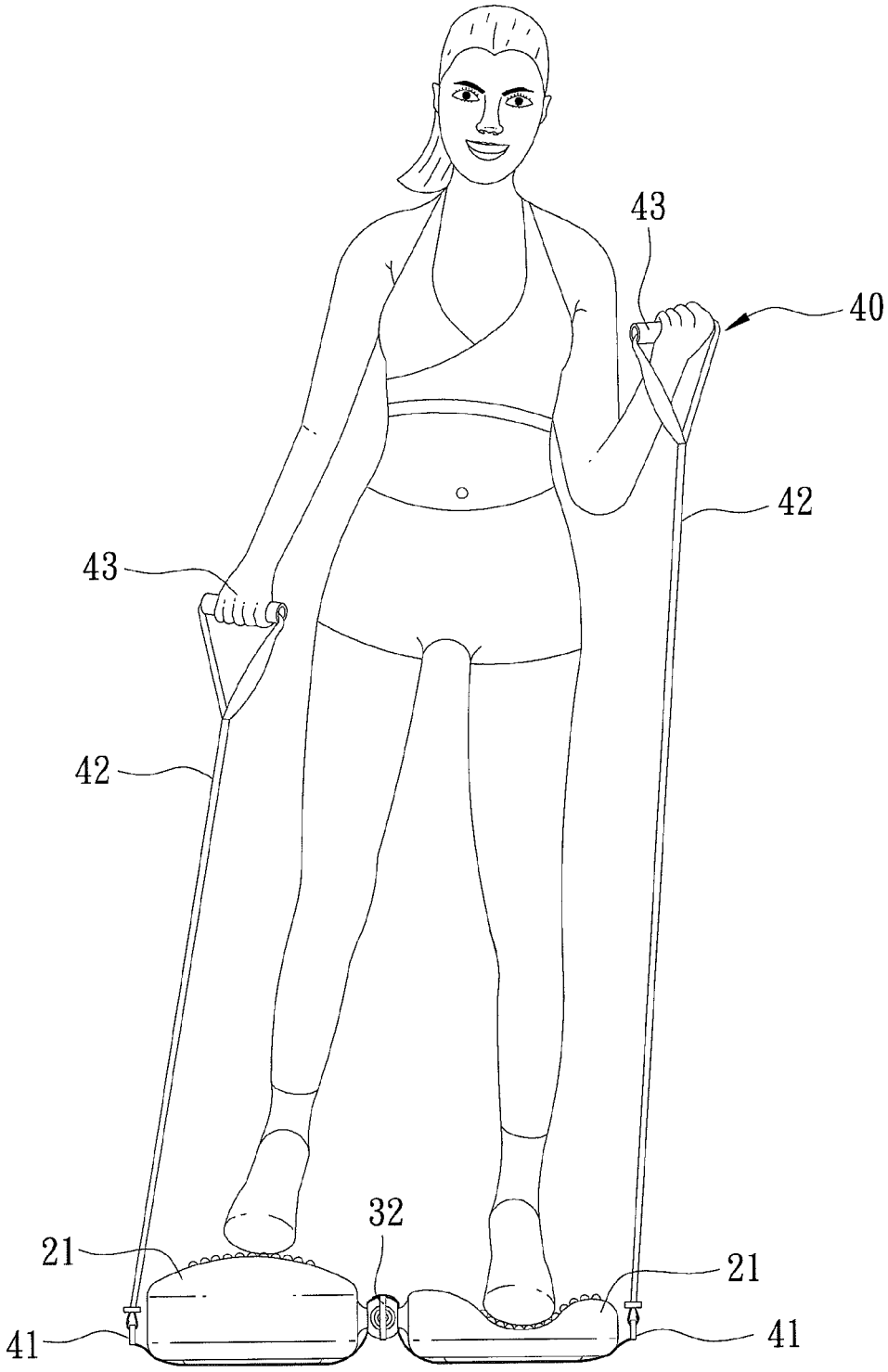
FIG. 19 illustrates a ninth exercise using the preferred embodiment.

As shown in FIGS. 18 and 19, the handle unit 40 includes a pair of connection ropes 41, a pair of pull ropes 42 and a pair of grips 43.

The connection ropes 41 are connected to the shell 31 of the flow regulator 30, laid respectively below the left and right foot pads 21, and extended to two opposite sides of the left and right foot pads 21.

Each of the pull ropes 42 has one end connected to a respective one of the connection ropes 41 and the other end connected to a respective one of the grips 43. In this embodiment, the pull ropes 42 are extensible elastic ropes.

When the user desires to adjust the resistance for strength training, the adjustment screw rods 32 are rotated to press or unpress the corresponding primary tubes 22, such that the primary tubes 22 are deformed to change the air resistance, the air flow speed passing through the primary tubes 22, and the deformation speed of the foot pads 21. Hence, the user may perform exercises while slowly inclining her body thereof frontward and rearward, and may train her balance sense under various exercise conditions and enhance her muscular strength. On the other hand, because the foot pads 21 and the primary tubes 22 are integrally formed as one piece, and because the air flow between the foot pads 21 is regulated by pressing the primary tubes 22 with the adjustment screw rods 32, no fluid seal is needed in the present invention. In addition, because the primary tubes 22 and the secondary tube 23 are shielded and protected by the shell 31 from damage, the purpose of durability is served.

As shown in FIGS. 18 and 19, while the user steps on the foot pads 21, her hands can simultaneously hold the grips 43. The user can pull the pulling ropes 42 in a standing pose to train the strength of both her legs and arms at the same time, and to train her balance sense.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A pneumatic exercise foot pad device comprising:

left and right foot pads each having an air chamber;

two primary tubes, and a secondary tube all of which are disposed between said left and right foot pads, one of said primary tubes intercommunicating fluidly front ends of said left and right foot pads, the other one of said primary tubes intercommunicating fluidly rear ends of said left and right foot pads, said secondary tube intercommunicating fluidly central portions of said left and right foot pads, said left and right foot pads and said primary and secondary tubes being made of a flexible plastic material;

a shell disposed between said left and right foot pads to cover said primary tubes and said secondary tube and that is made of a material stiffer than said flexible plastic material; and a flow regulator including two screw holes, one of each screw hole is formed in opposing ends of said shell, in proximity to said primary tubes, respectively, and two adjustment screw rods that are inserted into said shell respectively through said screw holes and that are operable to move inwardly of said shell and toward each other to press said primary tubes, or outwardly of said shell and away from each other to unpress said primary tubes, said primary tubes being compressible to reduce or block a fluid flow between said left and right foot pads when being pressed by said adjustment screw rods.

2. The pneumatic exercise foot pad device of claim 1, wherein said shell includes front and rear ends, said screw holes being formed respectively in said front and rear ends of said shell.

3. The pneumatic exercise foot pad device of claim 2, wherein said shell includes upper and lower shell members that are mated with each other, said primary tubes being disposed between said upper and lower shell members and proximate to said front and rear ends, respectively, said screw holes being formed in one of said upper and lower shell members.

4. The pneumatic exercise foot pad device of claim 3, wherein one of said upper and lower shell members includes front and rear end walls that respectively have said screw holes, and a plurality of spaced apart ribs between said front and rear end walls, the other one of said upper and lower shell members including a plurality of spaced apart grooves, said ribs being fitted respectively into said grooves, one of said primary tubes being disposed in a space between said front end wall and one of said ribs, the other one of said primary tubes being disposed in a space between said rear end wall and the other one of said ribs.

5. The pneumatic exercise foot pad device of claim 1, further comprising a handle unit including a pair of connection ropes that are connected to said shell, that are laid respectively below said left and right foot pads, and that extend to two opposite sides of said left and right foot pads, respectively, a pair of pull ropes respectively connected to said connection ropes, and a pair of grips respectively connected to ends of said pull ropes that extend away from said left and right foot pads.

* * * * *